US008763924B2

(12) United States Patent
Bösterling et al.

(10) Patent No.: US 8,763,924 B2
(45) Date of Patent: Jul. 1, 2014

(54) RAIL WEB DAMPING TO REDUCE SOUND ON RAIL LINES

(75) Inventors: Winfried Bösterling, Neuenrade (DE); Michael Harraβ, Wuppertal (DE); Jörg Happe, Meschede (DE); Dirk Vorderbrück, Werdohl (DE)

(73) Assignee: Vossloh Werke GmbH, Werdohl (DE)

( * ) Notice: Subject to any disclaimer, the term of this patent is extended or adjusted under 35 U.S.C. 154(b) by 0 days.

(21) Appl. No.: 13/503,419

(22) PCT Filed: Oct. 22, 2010

(86) PCT No.: PCT/EP2010/065962
§ 371 (c)(1),
(2), (4) Date: May 21, 2012

(87) PCT Pub. No.: WO2011/048209
PCT Pub. Date: Apr. 28, 2011

(65) Prior Publication Data

US 2012/0228394 A1 Sep. 13, 2012

(30) Foreign Application Priority Data

Oct. 22, 2009 (EP) ..... 09173760

(51) Int. Cl.
*E01B 19/00* (2006.01)
*E01B 9/00* (2006.01)

(52) U.S. Cl.
USPC ..... 238/382; 238/336

(58) Field of Classification Search
USPC ..... 238/2, 6, 122, 151, 152, 310, 336, 338, 238/382
See application file for complete search history.

(56) References Cited

U.S. PATENT DOCUMENTS 6,213,407 B1 * 4/2001 Ellis et al. ..... 238/310
2005/0258265 A1 11/2005 Wirthwein et al.

FOREIGN PATENT DOCUMENTS

| | | | |
|---|---|---|---|
| DE | 202008014701 | U1 | 2/2009 |
| EP | 0995837 | A1 | 4/2000 |
| FR | 2012921 | A1 | 3/1970 |
| WO | 9316230 | A1 | 8/1993 |
| WO | 2005012641 | A1 | 2/2005 |

OTHER PUBLICATIONS

International Search Report, dated Mar. 25, 2011, with respect to International Application No. PCT/EP2010/065962.

* cited by examiner

*Primary Examiner* — R. J. McCarry, Jr.
(74) *Attorney, Agent, or Firm* — Scott R. Cox

(57) ABSTRACT

A profiled element for damping sound vibrations on rail lines including a first main surface, which is designed and dimensioned such that it can be attached as a support surface to sections of the rail web without having to provide an adhesive layer, wherein the profiled element further has at least one recess on a front surface located opposite of the support surface, wherein the at least one recess in the front surface is designed for the positive engagement of an elastic fixing element for fixing the profiled element against the rail web, and at least one widened region of the profiled element in the region of the front surface, said widened region present in the lower region of the front surface in an installed position.

13 Claims, 2 Drawing Sheets

RAIL WEB DAMPING TO REDUCE SOUND ON RAIL LINES

FIELD OF THE INVENTION

The invention relates to a profiled element for damping sound vibrations on rail lines and to the use of a special profiled element for securing to the web of a rail to reduce sound on rail lines.

PRIOR ART

When trains are running on rail lines, audible rail vibrations can occur, which are particularly undesirable in residential areas or in the vicinity thereof. As rail vibrations occurring during operation often occur in specific places such as, for example, in narrow curves or in gradient sections, systems have already been developed in the prior art to dampen sound vibrations on rails.

A damping agent for sound vibrations on rails is known from WO03/085201 A1, said damping agent providing damping agents which are glued onto the rail web on both sides of the rail. The synthetic material used for the damping elements is shear-stressed and absorbs the vibrational energy in the rails through frictional energy. Preferably haematite and magnetite particles are introduced into the thermoplastic synthetic material in order to have a sufficient mass available to absorb sound waves. A metal clamp can be inserted in addition to gluing the damping elements to the rail web, said clamp elastically pressing the damping elements disposed on both sides of the rail web against the rail web.

A further solution to avoid rail vibrations is described in DE-A-1 784 171 and provides a coating in the web or head section of the rail which is made of a synthetic material not subject to any noteworthy shape modification under the effect of vibrations and to which one or several metal top sheets are secured. In this arrangement, the synthetic coating is provided by a 2-component material based on a filled resin and the metal sheets attached to the synthetic coatings are secured to the plastic-state synthetic material either by gluing or by pressing on the sheets.

DESCRIPTION OF THE INVENTION

Based on the prior art, the object of the invention is to propose improved rail web damping to reduce sound on rail lines which can be easily reused if the appropriate track section is dismantled.

This object is achieved by a profiled element to dampen sound vibrations on rail lines with the features of claim 1. The rail for a rail line comprising such a profiled element is described by the features of claim 7. Finally, the invention also relates to the use of a specially designed profiled element for securing to the web of a rail to reduce sound on rail lines.

The profiled element according to the invention for damping sound vibrations on rail lines has a first main surface which is designed and dimensioned such that it can be attached as a support surface to the rail web without having to provide an adhesive layer. The profiled element further comprises at least one recess on a front surface, which is located opposite the support surface, the at least one recess in the front surface being designed for the positive engagement of an elastic fixing element for fixing the profiled element against the rail web. The profiled element further comprises at least a widened region in the area of the front surface, which is disposed in the lower region of the front surface in the installed position.

Through the profiled element having a first main surface designed and dimensioned as a support surface, the profiled element can be attached directly to the rail web without the provision of an adhesive layer or even without the provision of a levelling layer. It should be noted here that the rail profiles have relatively high manufacturing tolerances so that the first main surface facing the rail web and rail foot in the installed position can purposefully also have regions next to the support surface that may be distanced from the rail line to accept manufacturing tolerances of the rail line. As it is not necessary to provide an adhesive layer between the profiled element and the rail web because of the specific design and dimensioning of the first main surface as support surface on the rail web, the profiled element can be easily dismantled and reused in a different place. Instead of an adhesive layer, a mechanical holding member can be provided for fixing the profiled element to the rail web. Thus, according to the invention, at least one recess on a front surface, which is located opposite the support surface, is provided for the positive engagement of an elastic fixing element for fixing the profiled element against the rail web. The recess serves to receive an elastic fixing element with which the profiled element can be pressed and particularly tensioned against the rail web. According to the invention, the profiled element is additionally shaped such that at least a widened region in the region of the front surface is provided, which is disposed in the lower region of the front surface in the installed position. In other words, the profiled element is widened in the place where it extends into the region of the rail foot. Due to the widened region in the profiled element extending to the rail foot, the total mass of the profiled element is increased thus improving the sound absorption properties. Moreover, the damping is improved in the vertical direction. "Widened region of the profiled element" means that the thickness of the profiled element in cross-section perpendicular to the longitudinal side of the profiled element is increased, the longitudinal side of the profiled element corresponding to the longitudinal side of the rail line to which the profiled element is attached in the installed position.

The rail according to the invention for a rail line accordingly comprises such a profiled element and is further characterised in that the elastic fixing element is a foot clip which encircles the rail foot on the one side of the rail and positively engages in one of the at least one recess of the profiled element on the other side of the rail.

In order to achieve the most efficient damping of sound vibrations, a profiled element can further be used with at least a layer of a weave with warp wires and weft wires and pores formed between the warp and weft wires, whereby elevations and/or depressions extending perpendicularly to the surface of the weave are formed by the textile structure, said elevations and/or depressions achieving a considerable improvement in the acoustic absorption property as this results in a considerably longer path for the sound and in addition an air cushion is formed which enlarges the boundary layer on the weave. The fraction of air which forms the boundary layer possesses a higher viscosity than the ambient air thus increasing the friction for the sound penetrating the boundary layer. In this way, the mass available for sound absorption can be increased due to a combination of the shaping according to the invention of the profiled element, and the absorption and dissipation of the sound can be further improved due to the provision of a suitable surface structure without a noteworthy additional increase in mass due to a different physical operating principle.

Preferred embodiments of the invention result from the other claims.

The profiled element preferably comprises a second recess on the rail side, i.e. in the region of the first main surface, and preferably in the lower region of the first main surface. This second recess is suitable as free space for running a cable through.

According to a preferred embodiment of the invention, the profiled element further comprises at least one, preferably two, cut-outs in the widened region, which in the installed position expose the rail foot at least in sections for attaching a rail fastening. As the widened region according to the invention is located in the lower region of the front surface of the profiled element, said widened region extending far into the region of the rail foot so that, depending on the geometry of the widened region, there can no longer be sufficient room available for a tension clamp, which sits on the rail foot and tensions the same against the sleeper disposed underneath it. Alternatively, however, the profiled element can be executed in a shorter length, i.e. with less length, so that there is no interference with the tension clamp. Due to the provision of cut-outs corresponding to the conventional distance between the sleepers, this problem can be solved and, despite the provision of an increased mass for the improved sound protection, the attachment of a rail fastening can be carried out in the traditional way.

Preferably, the at least one recess in the profiled element is dimensioned on the front surface such that this only receives a single elastic fixing element. The advantage of this measure consists therein that an exact alignment can thus be achieved in the longitudinal direction of the profiled element and of the rail line. The elastic fixing element positively engages in the at least one recess, and the recess is additionally dimensioned such that it can only receive one elastic fixing element. In this arrangement, the recess can be designed such that it is a vertically-disposed groove in the installed direction. In this way, this avoids the profiled elements being misaligned in the longitudinal direction.

It has been proven to be advantageous if the profiled element consists of a thermoplastic or elastomeric synthetic material with metallic or mineral, i.e. inorganic, particles embedded in it, preferably homogeneously distributed. The basic geometry of such a profiled element can be manufactured preferably by extrusion and injection moulding methods or other plastic-processing methods but has a relatively high weight thereby improving the desired damping of acoustic vibrations. At the same time, the profiled element is weather-resistant and can easily mould to the rail web due to a certain elasticity in the geometric shape. The profiled element can consist of a thermoplastic material or elastomer, preferably a polyolefin such as polypropylene.

Alternatively, the profiled element is designed such that it has at least a layer of a weave of warp wires and weft wires and pores formed between the warp wires and weft wires, the weave being provided with a plurality of elevations and/or depressions extending essentially perpendicularly to its surface, said elevations and/or depressions preferably having a height of at least 0.5 mm. The advantage of such a weave particularly in the region of the front surface has already been explained previously and serves to improve acoustic damping.

The profiled element preferably possesses a length of about 500 mm. Unlike traditional profiled elements, which generally have a marked longer length, the shorter-executed profiled element offers simpler installing, improved seating on the rail web in curve radii and, when using traditional springs, greater surface pressure on the rail web.

The profiled element optionally has two cut-outs, which expose the rail foot so that, when the rail is in the installed position, a tension clamp can be inserted in the region of each of the cut-outs to elastically press the rail foot down onto a sleeper.

Furthermore, at least one profiled element is attached preferably to both sides of the rail thus optimising the damping of sound vibrations.

According to a preferred embodiment of the profiled element that has at least one layer of a weave of warp wires and weft wires, these warp wires and weft wires in the weave consist of an aluminium alloy, steel, stainless steel, aluminium or another light metal, synthetic material, ceramic, a copper alloy or a natural fibre.

SHORT DESCRIPTION OF THE DRAWINGS

Purely by way of example, further features of the invention will emerge from the following description of an embodiment which is shown in the accompanying drawings, in which.

WAYS OF CARRYING OUT THE INVENTION

Figure 1:
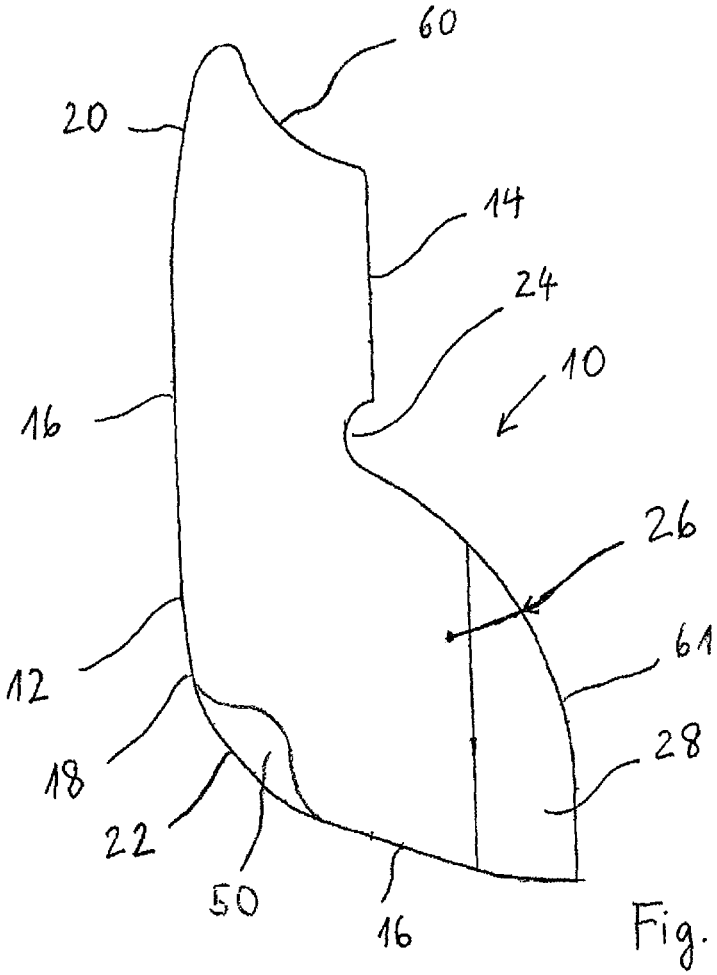
FIG. 1 is a first view of a profiled element according to the invention.

In the following figures, identical construction elements are each numbered with identical reference numerals.

FIG. 1 shows a view of a profiled element 10 according to the invention, the profiled element being represented from the front face and in a position corresponding to the installed position on a horizontally-laid rail line. The main extension, and thus the longitudinal direction, of the profiled element 10 extends perpendicularly to the plane of projection in FIG. 1. The profiled element 10 has a first main surface 12 and a front surface 14 disposed opposite the first main surface 12. In the built-in position represented in FIG. 3, the first main surface 12 is in contact at essential sections with the web and foot of a rail of conventional geometry so that a substantial part of the first main surface simultaneously forms a support surface 16, which, in the installed position, is in contact with the corresponding rail line. The radii of the first main surface are adjusted to the geometry of the rail. However, larger radii than match that of the corresponding rail line can also be purposefully provided in sections of the first main surface 12 in order to be able to compensate for size tolerances of the rail. In this arrangement, particularly the first section 18 and the second section 20 can each have a larger radius than matches the corresponding rail geometry in the web region. Moreover, a third section 22 is provided in which the profiled element 10 is milled in order to ensure a full-surface abutment to the web of the rail in the region of the support surface 16 with the manufacturing tolerances of the corresponding rail. Each extension in regions 18, 20 and 22 can be seen in the representation in FIG. 3 where these regions do not abut the rail.

Figure 3:
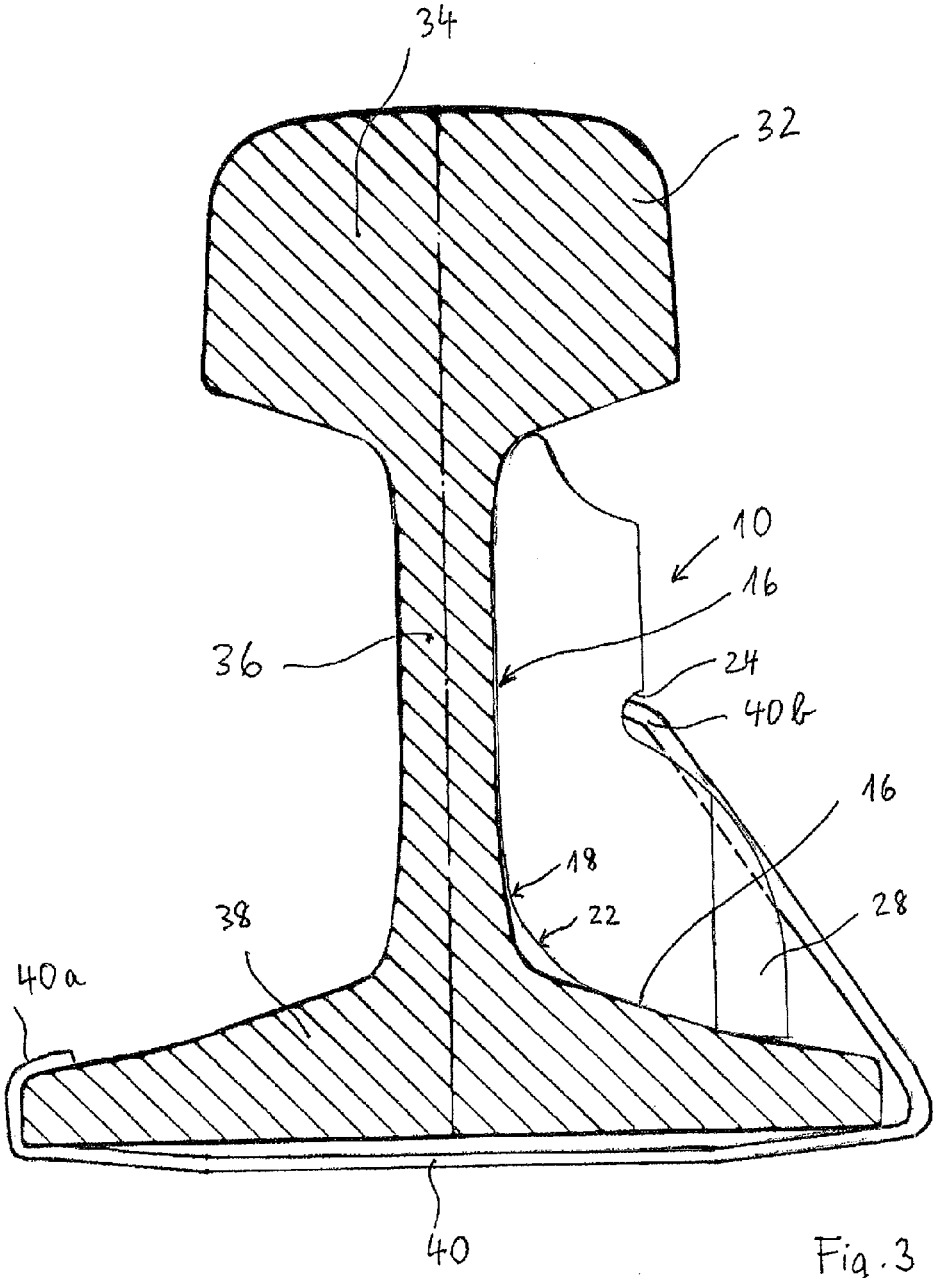
FIG. 3 is a schematic representation of the section through a rail line with a profiled element according to the invention attached to it.

On the front surface 14, the profiled element has a longitudinally-running, preferably continuous recess 24 on one side which serves to positively engage an elastic fixing element, as shown by the schematic representation of a holding clip in FIG. 3, in order to preferably elastically press the profiled element against the rail web.

FIG. 1 also shows that the profiled element 10 is provided with a widened region 26 in the region of the front surface 14, said widened region being disposed in the lower section of the front surface 14, the term "lower" referring to the installed position for a horizontally-disposed rail line. The total mass of the profiled element 10 is increased by the widened region 26, thus improving the damping function of sound vibrations. Thus, due to the special arrangement of the widened region 26 in the lower region of the front surface, the damping is increased in the vertical direction and the additional material disposed in a region where it least interferes, namely in the region of the rail foot when the profiled element is installed. Finally, a recess 50 can be disposed on the rail foot to receive, for example, cables.

The widened region 26 interferes only in the region of the fastening point of the rail to the sleepers where tension clamps are conventionally used to elastically secure the rails onto sleepers, therefore at least one cut-out 28, preferably a cut-out 28 is disposed at each longitudinal end of the profile. The geometry of the cut-out 28 is best seen in FIG. 2, which shows a cut-out 28 in each case disposed at each longitudinal end of the profiled element 10 and extending from the front surface 14 into the material of the widened region 26.

The concave radius 60 provided at the upper end of the front surface 14 is matched to the convex radius 61 in the widened region 26 such that profiled elements laid on top of each other in opposite directions can be stacked on top of each other with only minimal free space thus reducing the transport volume and simplifying storage.

Figure 2:
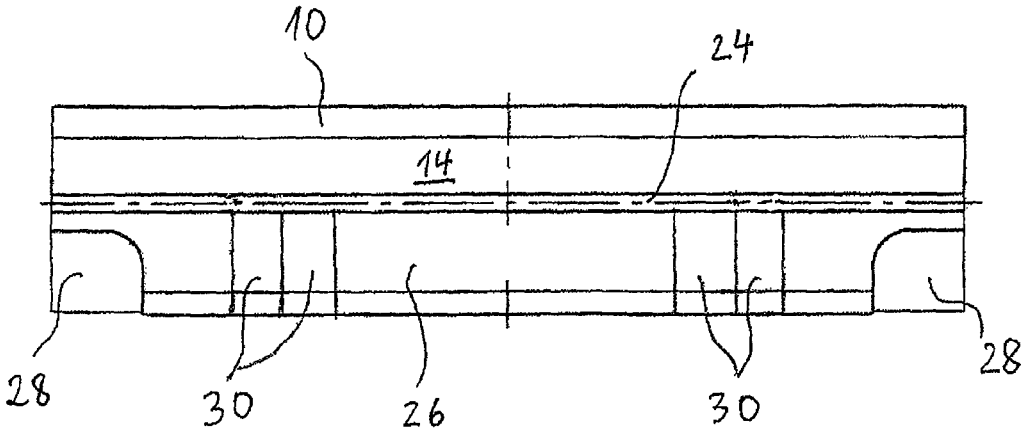
FIG. 2 is a second view of the profiled element represented in FIG. 1.

FIG. 2 also shows grooves 30 running vertically, which extend from the side of the front surface 14 into the widened region 26 and from the underside of the profiled element to the recess 24. The grooves 30 serve to receive suitable elastic fixing elements, e.g. metal clamps, such that they extend into the grooves 30 and prevent a longitudinal shift in the profiled element through appropriate dimensioning of the width of the grooves matched to the width of the elastic fixing element. Preferably a total of four grooves per profiled element are provided so that the securing clamps can be disposed offset to each other when attaching each profiled element on both sides of the rail web.

FIG. 3 shows a traditional rail 32 with rail head 34, rail web 36 and rail foot 38. The profiled element 10 represented in FIG. 1 is disposed on the rail web 36 in the installed position in FIG. 3, the profiled element 10 abutting the rail web and rail foot in the region of the support surface 16. The profiled element 10 is not abutting the rail in region 22 in order to accommodate manufacturing tolerances particularly in the region of the radii between rail head and rail web and between rail web and rail foot. Compared to the embodiment according to FIG. 1, the profiled element according to FIG. 3 does not possess a second recess for running a cable through.

As can be seen in FIG. 3, the profiled element directly abuts the rail, the term "directly" meaning that no levelling layer or adhesive layer is located between the profiled element and the stock rail 32. To still ensure a secure arrangement and a suitable pressing pressure between the profiled element and stock rail, at least two holding clips 40 are provided for each profiled element, said clamps encircling the rail foot in the region 40*a* on the side of the rail facing away from the profiled element, running under the rail foot and guided round the rail foot on the side facing the profiled element and preferably running through a groove not represented in FIG. 3 and pressing into the recess 24 of the profiled element with the region 40*b*. In this way, the profiled element 10 is fixed to the stock rail without using an adhesive layer whereby, after removing the holding clips 10 [sic], the profiled element can be easily dismantled from the stock rail and reused in a different place.

In the example represented in FIG. 3, a profiled element 10 is disposed only on one side of the rail but the element is preferably disposed on both sides of the rail, the holding clips being disposed in a mirror image of the holding clips represented by way of example in FIG. 3 in order to also tension against the rail web the further profiled element not represented in FIG. 3.

The profiled element represented in FIG. 1 can be manufactured from a thermoplastic or elastomeric synthetic material in which metallic or mineral, such as inorganic, particles are embedded, which can be extruded, injection-moulded or manufactured by typical plastic-processing methods with the synthetic material and which possess the function of increasing the mass of the profiled element. Alternatively and in addition, it is also possible to provide a multi-layer construction whereby a structure can be provided as described in DE 20 2008 014 701 U1, which describes that at least a layer of weave of warp wires and weft wires can be provided on a suitable absorption material, pores formed between the warp wires and weft wires being present and the weave being provided with a plurality of elevations and/or depressions extending essentially perpendicularly to its surface, said elevations and/or depressions each having a height of at least 0.5 mm. Reference is made to the disclosure content of DE 20 2008 014 701 U1 for the exact description of such a layer material. In this arrangement, an appropriate woven layer can be disposed both on the first main surface 12 and the front surface 14 of the profiled element 10. However, as an alternative to the special layer construction described in DE 20 2008 014 701 U1, a layer construction consisting of thermoplastic material with metallic particles and/or mineral particles can also be combined with an appropriate woven layer with warp wires and weft wires on its surface. However, it is crucial that although the profiled element 10 itself can consist of different layers that are laminated to each other, the profiled element can be secured to the stock rail without using an adhesive layer.

By means of the profiled element according to the invention, an optimal coupling to the rail web is possible without using an adhesive layer and by means of the widened region in the profiled element towards the rail foot, the mass and the damping is increased in a vertical direction. However, dispensing with adhesives also results in simple dismantling and reusing of the profiled element.

The invention claimed is:

1. A profiled element to dampen sound vibrations on rail lines comprising a first main surface, which is designed and dimensioned to be attached as a support surface to sections of a rail web without having to provide an adhesive layer;

a recess on a front surface of the profiled element, which is located opposite the support surface, wherein the recess in the front surface positively engages an elastic fixing element for fixing the profiled element against the rail web;

a widened region in the front surface of the profiled element, which is disposed in a lower region of the front surface in an installed position; and a cut out in an outside surface of the widened region opposite to the rail web, which in installed position, exposes sections of a rail foot for attaching a rail fastening.

2. The profiled element according to claim 1, further comprising a second recess on the first main surface, which is suitable for running a cable through.

3. The profiled element according to claim 1 further comprising at least a layer of a weave of warp wires and weft wires and pores formed between the warp wires and weft wires, wherein the weave is provided with a plurality of elevations and/or depressions extending essentially perpendicularly to its surface, wherein said elevations and/or depressions each have a height of at least 0.5 mm.

4. The profiled element of claim 3, wherein the warp wires and weft wires of the weave are selected from the group consisting of an aluminium alloy, steel, stainless steel, aluminium or another light metal, synthetic material, ceramic, copper alloy and a natural fiber.

5. The profiled element according to claim 1, wherein the recess on the front surface is dimensioned in sections such that it only accepts the elastic fixing element.

6. The profiled element according to claim 1, wherein the profiled element is produced from a material selected from the group consisting of a thermoplastic and an elastomeric synthetic material, each with metallic or mineral particles embedded therein.

7. The profiled element of claim 6 wherein the metallic or mineral particles are homogeneously distributed within the material.

8. The profiled element according to claim 1, wherein the profiled element possesses a length of about 500 mm.

9. A rail for a rail line comprising the profiled element according to claim 1, characterised in that the elastic fixing element comprises a foot clip, which encircles the rail foot on one side of the rail and positively engages the recess of the profiled element on the other side of the rail.

10. The rail according to claim 9, characterised in that on both sides of the rail at least one profiled element is attached.

11. The profiled element of claim 1 further comprising more than one cut out in the widened area.

12. The profiled element of claim 1 further comprising more than one recess on the front surface.

13. The profiled element of claim 1 further comprising more than one widened region.

* * * * *